US009731342B2

(12) United States Patent
Breneman et al.

(10) Patent No.: US 9,731,342 B2
(45) Date of Patent: Aug. 15, 2017

(54) CHILL PLATE FOR EQUIAX CASTING SOLIDIFICATION CONTROL FOR SOLID MOLD CASTING OF RETICULATED METAL FOAMS

(71) Applicant: UNITED TECHNOLOGIES CORPORATION, Hartford, CT (US)

(72) Inventors: Ryan C Breneman, West Hartford, CT (US); Steven J Bullied, Pomfret Center, CT (US); Ryan B. Noraas, Vernon, CT (US); John F Blondin, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 29 days.

(21) Appl. No.: 14/792,997

(22) Filed: Jul. 7, 2015

(65) Prior Publication Data

US 2017/0008071 A1 Jan. 12, 2017

(51) Int. Cl.

| | |
|---|---|
| ***B22C 7/02*** | (2006.01) |
| ***B22D 25/00*** | (2006.01) |
| ***B22C 9/04*** | (2006.01) |
| ***B22C 9/22*** | (2006.01) |
| ***B22D 15/04*** | (2006.01) |

(52) U.S. Cl.

CPC ..... *B22C 7/023* (2013.01); *B22C 9/04* (2013.01); *B22C 9/22* (2013.01); *B22D 15/04* (2013.01); *B22D 25/005* (2013.01)

(58) Field of Classification Search

CPC ..... B22D 25/005; B22D 27/00; B22D 27/04; B22D 27/045; B22D 15/00; B22D 15/04; B22C 9/00; B22C 9/04; B22C 9/043; B22C 9/046; B22C 9/065

See application file for complete search history.

(56) References Cited

U.S. PATENT DOCUMENTS

| | | | |
|---|---|---|---|
| 3,616,841 | A | 11/1971 | Walz |
| 3,946,039 | A | 3/1976 | Walz |
| 5,720,597 | A | 2/1998 | Wang et al. |
| 6,187,411 | B1 | 2/2001 | Palmer |
| 6,412,541 | B2 | 7/2002 | Roesler et al. |

(Continued)

FOREIGN PATENT DOCUMENTS

| | | | |
|---|---|---|---|
| CN | 103117258 | A | 5/2013 |
| KR | 20010084734 | A | 9/2001 |

OTHER PUBLICATIONS

European Extended Search Report dated Oct. 27, 2016, issued in the corresponding European Patent Application No. 16178354.3.

(Continued)

*Primary Examiner* — Kevin P Kerns
*Assistant Examiner* — Steven Ha
(74) *Attorney, Agent, or Firm* — Bachman & LaPointe, P.C.

(57) ABSTRACT

A method to manufacture reticulated metal foam via a dual investment solid mold includes pouring molten metal material into a mold while the mold is located on a chill plate. A method to manufacture reticulated metal foam includes pouring molten metal material into a mold while the mold is located on a chill plate, the chill plate configured to apply an externally driven temperature gradient in the mold so that solidification progresses from the chilled end to the non-chilled end.

18 Claims, 8 Drawing Sheets

(56) References Cited

U.S. PATENT DOCUMENTS

| | | | |
|---|---|---|---|
| 6,443,700 | B1 | 9/2002 | Grylls et al. |
| 6,652,222 | B1 | 11/2003 | Wojtyczka et al. |
| 6,711,902 | B2 | 3/2004 | Douglas |
| 6,827,556 | B2 | 12/2004 | Simon |
| 6,857,461 | B2 | 2/2005 | Girlich et al. |
| 6,913,436 | B2 | 7/2005 | McMillan et al. |
| 6,971,841 | B2 | 12/2005 | Care |
| 7,045,237 | B2 | 5/2006 | Sridhar et al. |
| 7,067,208 | B2 | 6/2006 | Gottmann et al. |
| 7,092,484 | B1 | 8/2006 | Jensen et al. |
| 7,118,920 | B2 | 10/2006 | Brophy et al. |
| 7,125,217 | B2 | 10/2006 | Care |
| 7,135,248 | B2 | 11/2006 | Finn et al. |
| 7,144,651 | B2 | 12/2006 | Finn et al. |
| 7,175,387 | B2 | 2/2007 | Kreis et al. |
| 7,255,956 | B2 | 8/2007 | McElroy et al. |
| 7,448,849 | B1 | 11/2008 | Webster et al. |
| 7,513,734 | B2 | 4/2009 | McMillan |
| 7,524,162 | B2 | 4/2009 | Reigl |
| 7,588,421 | B2 | 9/2009 | Burdgick et al. |
| 7,594,325 | B2 | 9/2009 | Read |
| 7,604,199 | B2 | 10/2009 | McMillan et al. |
| 7,604,781 | B2 | 10/2009 | Brophy et al. |
| 7,753,654 | B2 | 7/2010 | Read et al. |
| 7,766,603 | B2 | 8/2010 | Beckford et al. |
| 7,766,625 | B2 | 8/2010 | Burdgick et al. |
| 7,775,766 | B2 | 8/2010 | Meier et al. |
| 7,905,016 | B2 | 3/2011 | James et al. |
| 7,922,456 | B2 | 4/2011 | McMillan |
| 7,942,639 | B2 | 5/2011 | Burdgick et al. |
| 7,946,827 | B2 | 5/2011 | Beckford |
| 7,950,147 | B2 | 5/2011 | Meier et al. |
| 7,968,144 | B2 | 6/2011 | James et al. |
| 8,047,001 | B2 | 11/2011 | Beeck et al. |
| 8,052,378 | B2 | 11/2011 | Draper |
| 8,092,148 | B2 | 1/2012 | Seitz et al. |
| 8,231,328 | B2 | 7/2012 | Reed |
| 8,246,291 | B2 | 8/2012 | Wolford |
| 8,297,912 | B2 | 10/2012 | Reed |
| 8,304,136 | B2 | 11/2012 | Lee et al. |
| 8,313,288 | B2 | 11/2012 | Schlichting et al. |
| 8,327,911 | B2 | 12/2012 | Kush et al. |
| 8,333,552 | B2 | 12/2012 | Wood et al. |
| 8,721,290 | B2 | 5/2014 | Darkins, Jr. et al. |
| 8,763,360 | B2 | 7/2014 | Murdock |
| 8,777,582 | B2 | 7/2014 | Darkins, Jr. et al. |
| 8,777,583 | B2 | 7/2014 | Darkins, Jr. et al. |
| 8,870,547 | B2 | 10/2014 | Grase et al. |
| 2003/0215689 | A1 | 11/2003 | Keegan |
| 2004/0167270 | A1* | 8/2004 | Chang ..... B22C 7/02 524/487 |
| 2011/0048664 | A1* | 3/2011 | Kush ..... B28B 1/001 164/6 |

OTHER PUBLICATIONS

T S Piwonka et al., "A comparison of lost pattern casting processes", Materials And Design, London, GB, vol. 11, No. 6, Dec. 1, 1990, pp. 283-290, XP024152793, ISSN: 0261-3069, DOI: 10.1016/0261-3069 (90) 90010-H.

Alexander Martin Matz et al., "Mesostructural Design and Manufacturing of Open-Pore Metal Foams by Investment casting", Advances in Materials Science and Engineering, vol. 45, No. 1, Jan. 1, 2014, pp. 279-9, XP055314136, ISSN: 1687-8434, DOI: 10.2320/matertrans.47.2195.

* cited by examiner

CHILL PLATE FOR EQUIAX CASTING SOLIDIFICATION CONTROL FOR SOLID MOLD CASTING OF RETICULATED METAL FOAMS

BACKGROUND

The present disclosure relates to metal foams, more particularly, to methods to manufacture metal foams.

Reticulated metal foams are porous, low-density solid foams that include few, if any, intact bubbles or windows. Reticulated metal foams have a wide range of application and may be utilized in many aerospace applications.

Numerous existing manufacturing technologies for producing reticulated metal foams have been attempted. However, automated production of such reticulated structures may be rather difficult to implement as the ceramic investment often proves difficult to remove without damage to the resultant relatively delicate metallic foam structure. Further, the existing manufacturing technologies lack the capability to efficiently manufacturer relatively large sheets of metal foam as the weight of the ceramic investment is sufficient to crush and convolute the shape of the polyurethane foam precursors. This may result in castability complications, polymer burnout, and reduced dimensional tolerances.

Standard investment casting in a flask tends to insulate the cast metal evenly resulting in heat retention in the center of the mold. This may lead to porosity in the casting and much effort is expended in mold design to direct this internal hot zone to non-critical areas of the casting.

SUMMARY

A method to manufacture reticulated metal foam according to one disclosed non-limiting embodiment of the present disclosure can include pouring molten metal material into a mold while the mold is located on a chill plate operable to provide chilling of an extent that a casting formed by the mold remains equiaxial with crystallization nucleating from all surfaces.

A further embodiment of the present disclosure may include pre-investing a precursor with a diluted pre-investment ceramic plaster to encapsulate the precursor; and investing the encapsulated precursor with a ceramic plaster to form the mold.

A further embodiment of any of the embodiments of the present disclosure may include, wherein the precursor is a reticulated foam structure.

A further embodiment of any of the embodiments of the present disclosure may include, wherein the precursor is a polyurethane reticulated foam structure.

A further embodiment of any of the embodiments of the present disclosure may include, wherein the precursor is completely encapsulated with the diluted pre-investment ceramic plaster.

A further embodiment of any of the embodiments of the present disclosure may include coating the precursor in a molten wax to increase ligament thickness.

A further embodiment of any of the embodiments of the present disclosure may include coating the precursor in a molten wax to increase ligament thickness to provide an about 90% air to 10% precursor ratio.

A further embodiment of any of the embodiments of the present disclosure may include, wherein the ceramic plaster is more rigid than the diluted pre-investment ceramic plaster.

A further embodiment of any of the embodiments of the present disclosure may include, wherein the diluted pre-investment ceramic plaster is about 55:100 water to powder ratio.

A further embodiment of any of the embodiments of the present disclosure may include, wherein the ceramic plaster is about 28:100 water to powder ratio.

A further embodiment of any of the embodiments of the present disclosure may include, wherein the chill plate operates at about room temperature.

A further embodiment of any of the embodiments of the present disclosure may include, wherein the molten metal material is at a temperature of about 1350° F. (732° C.).

A further embodiment of any of the embodiments of the present disclosure may include, wherein the chill plate applies an externally driven temperature gradient in the mold so that solidification progresses from the chilled end to the non-chilled end.

A further embodiment of any of the embodiments of the present disclosure may include, wherein the reticulated metal foam is manufactured of aluminum.

A method to manufacture reticulated metal foam via a dual investment solid mold according to another disclosed non-limiting embodiment of the present disclosure can include coating a precursor in a molten wax to increase ligament thickness; pre-investing the waxed precursor with a diluted pre-investment ceramic plaster to encapsulate the precursor; investing the encapsulated precursor with a ceramic plaster to form a mold; and pouring molten metal material into the mold while the mold is located on a chill plate.

A further embodiment of any of the embodiments of the present disclosure may include, wherein the precursor is a reticulated foam structure.

A further embodiment of any of the embodiments of the present disclosure may include, wherein the chill plate applies an externally driven temperature gradient in the mold so that solidification progresses from the chilled end to the non-chilled end.

A further embodiment of any of the embodiments of the present disclosure may include, wherein the extent of chilling is such that a casting formed by the mold remains equiaxial in nature with crystallization nucleating from all surfaces.

A method to manufacture reticulated metal foam according to another disclosed non-limiting embodiment of the present disclosure can include locating a mold on a chill plate, the chill plate configured to apply an externally driven temperature gradient in the mold so that solidification of a molten metal material in the mold progresses from a chilled end to a non-chilled end of the mold.

A further embodiment of any of the embodiments of the present disclosure may include, wherein the extent of chilling is such that a casting formed by the molten metal material remains equiaxial with crystallization nucleating from all surfaces.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
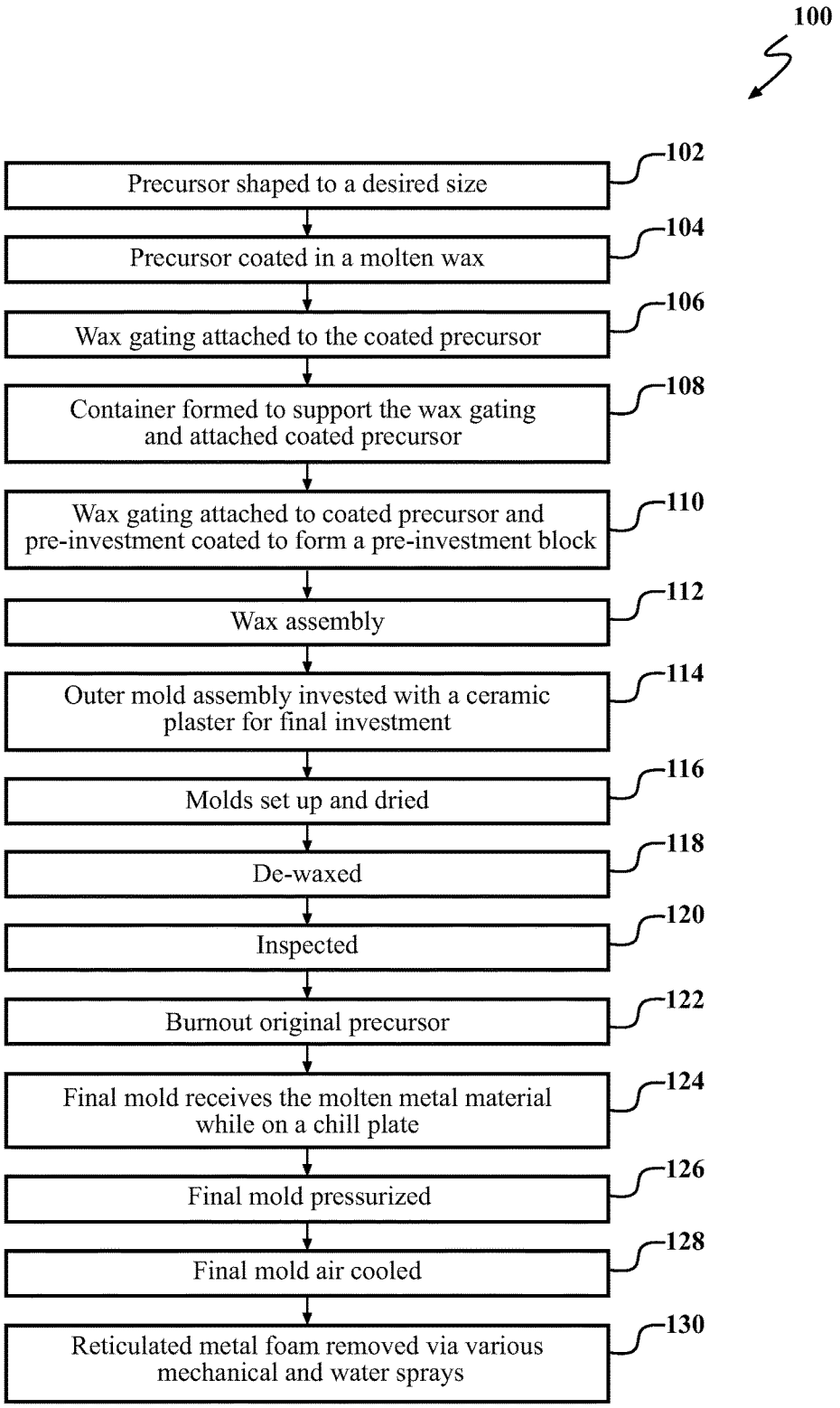
FIG. 1 is a schematic block diagram of a method to manufacture reticulated metal foam via a dual investment solid mold according to one disclosed non-limiting embodiment.

FIG. 1 schematically illustrates a method 100 to manufacture reticulated metal foam via a dual investment solid mold according to one disclosed non-limiting embodiment. The reticulated metal foam is typically manufactured of aluminum, however, other materials will also benefit herefrom.

Initially, a precursor 20 (FIG. 2) such as a polyurethane reticulated foam structure or other such reticulated material shaped to a desired size and configuration (step 102). In one example, the precursor 20 may be about 2' by 1' by 1.5". In some embodiments, the precursor 20 may be a commercially available 14 ppi polyurethane foam such as that manufactured by INOAC USA, INC of Moonachie, N.J. USA, although any material that provides desired pore configurations are usable herewith.

Figure 2:
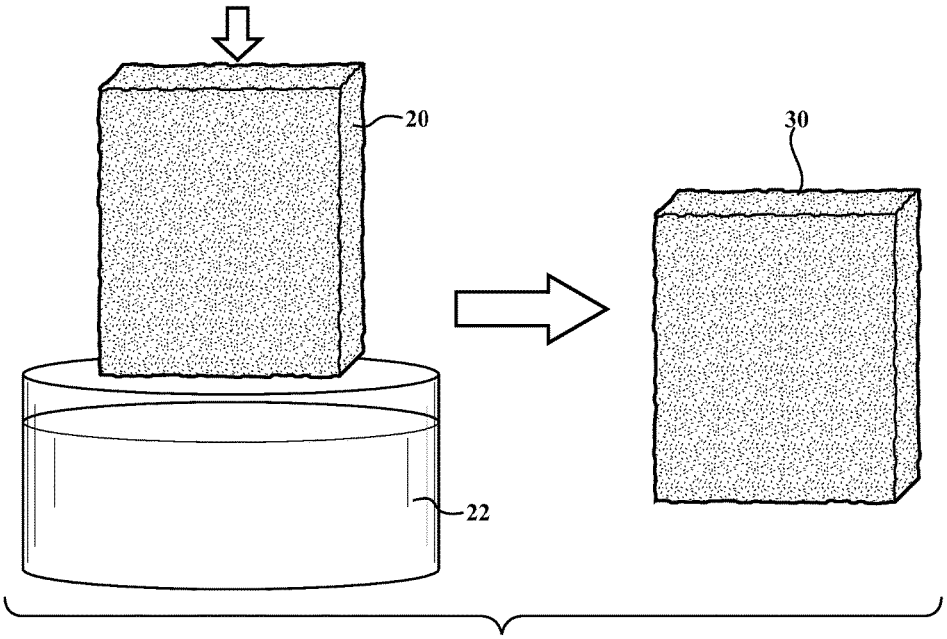
FIG. 2 is a schematic view of one step in the method to manufacture reticulated metal foam.

Next, the precursor 20 is heated, then dipped or otherwise coated in a molten wax 22 to increase ligament thickness (Step 104; FIG. 2). The wax may be melted in an electric oven at ~215° F. and the precursor 20 may be preheated simultaneously therein as well. In one example, the wax coating increased ligament/strut thickness to provide an about 90% air to 10% precursor ratio to facilitate castability with thicker struts and channels for metal, however, other densities will benefit herefrom as waxing the foam enables casting of the foam due to the passageways formed during de-wax and burnout. The wax coating also facilitates improved/accelerated burnout (passageways for gas).

It should be appreciated that various processes may be utilized to facilitate the wax coating such as location of the precursor 20 into the oven for a few minutes to re-melt the wax on the precursor 20; utilization of an air gun used to blow out and/or to even out the wax coating; and/or repeat the re-heat/air gun process as necessary to produce an even coating of wax. Alternatively, or in addition, the precursor 20 may be controlled a CMC machine to assure that the wax coating is consistently and equivalently applied. The precursor 20 is then a coated precursor 30 that is then allowed to cool (FIG. 2).

Figure 3:
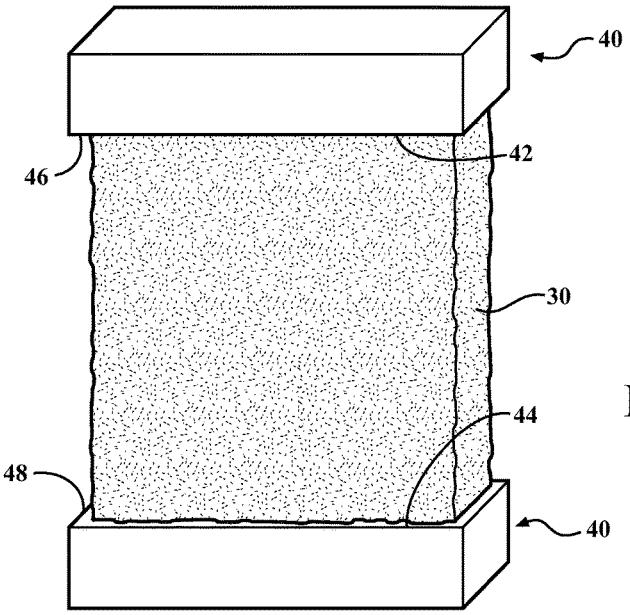
FIG. 3 is a schematic view of one step in the method to manufacture reticulated metal foam.

Next, a wax gating 40 is attached to each end 42, 44 of the coated precursor 30 (step 106; FIG. 3). An edge face 46, 48 of the respective wax gating 40 may be dipped into melted wax as a glue and attached to the coated precursor 30.

Figure 4:
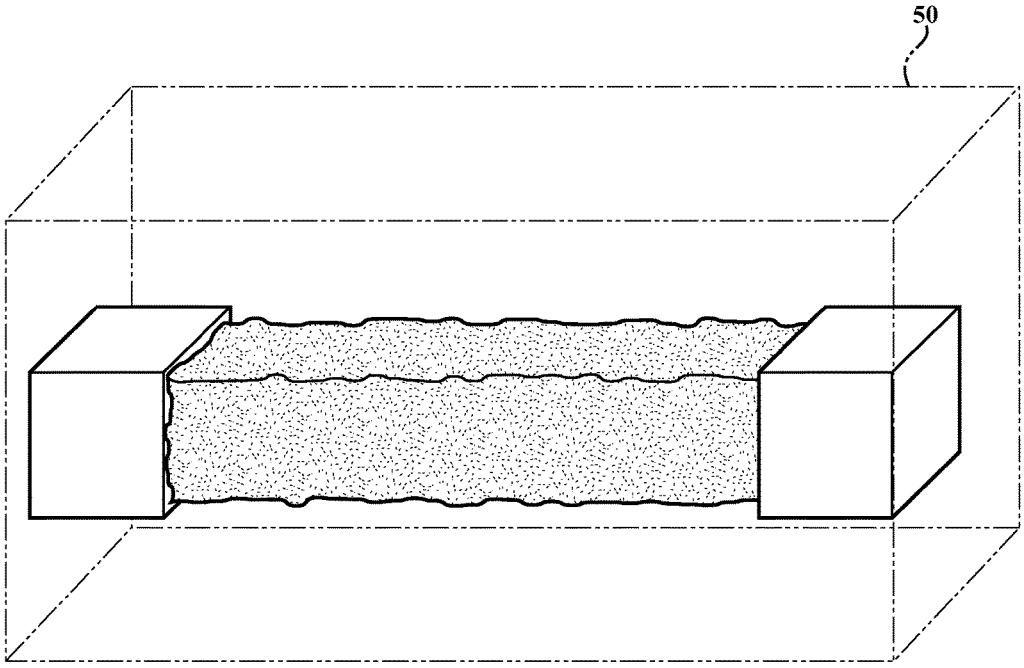
FIG. 4 is a schematic view of one step in the method to manufacture reticulated metal foam.
Figure 5:
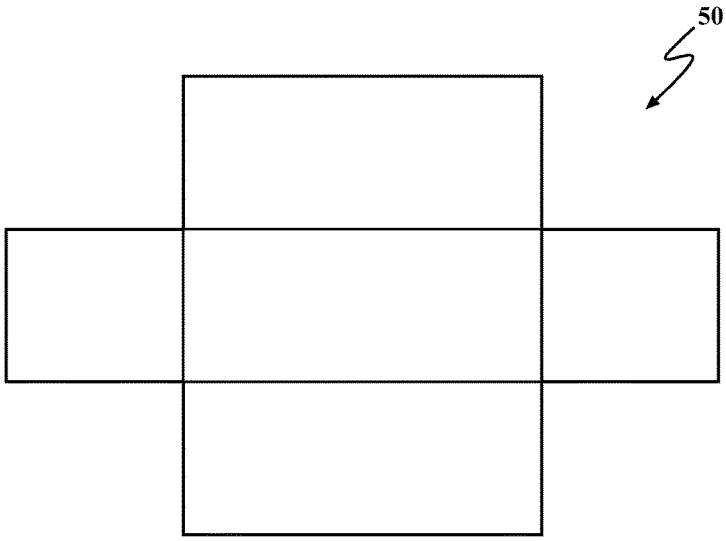
FIG. 5 is a schematic view of one step in the method to manufacture reticulated metal foam.

Next, a container 50 is formed to support the wax gating 40 and attached coated precursor 30 therein (step 108; FIG. 4). In some embodiments, the container 50 may be formed as an open-topped rectangular container manufactured from scored sheet wax of about 1/16" thick (FIG. 5). It should be appreciated that other materials such as plastic, cardboard, and others may be utilized to support the wax gating 40 and attached coated precursor 30 therein as well as contain a liquid such that the wax gating 40 can be completely submerged. In one example, the container 50 is about twice the depth of the wax gating 40 and provides spacing completely around the coated precursor 30.

Figure 6:
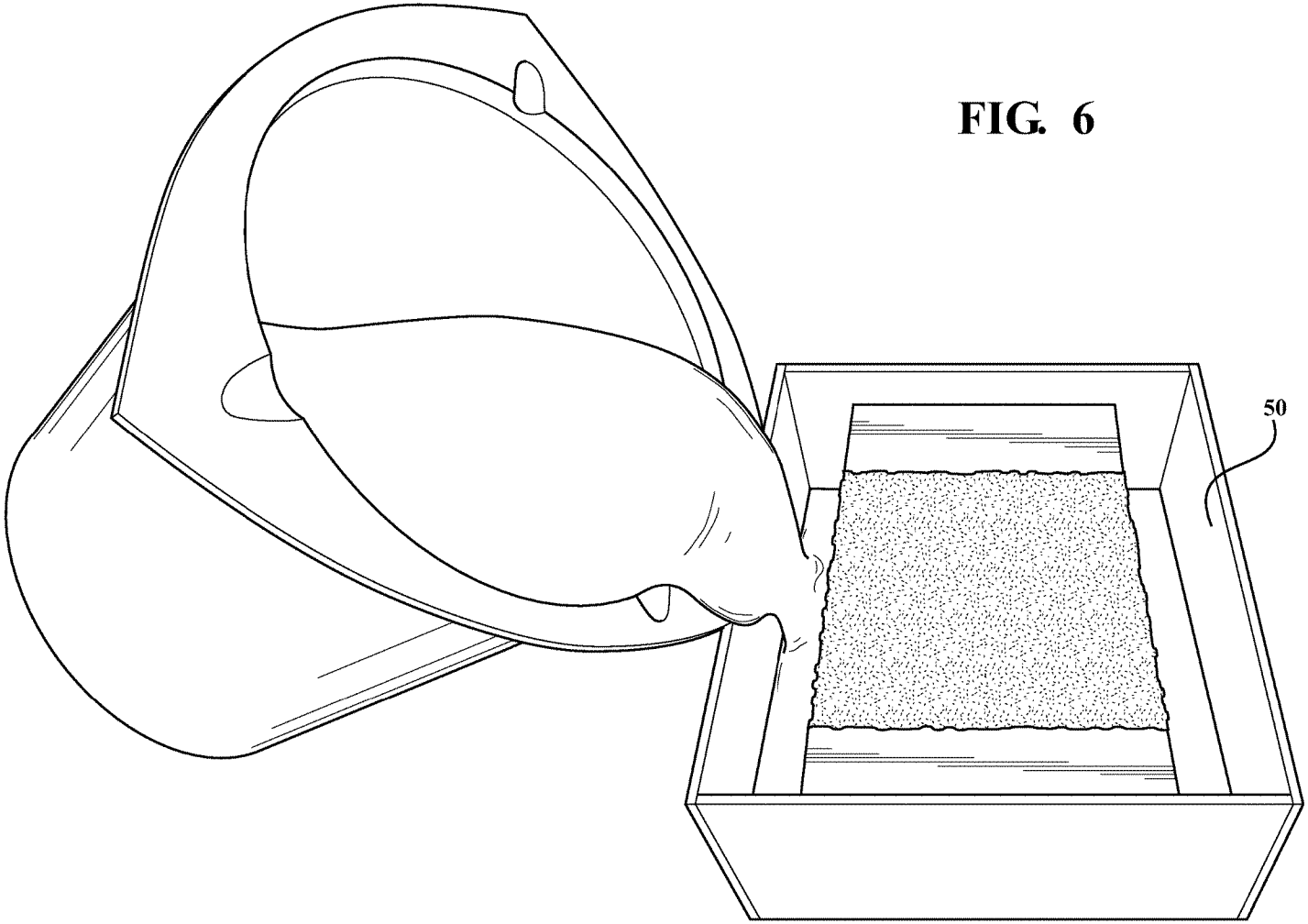
FIG. 6 is a schematic view of one step in the method to manufacture reticulated metal foam.
Figure 7:
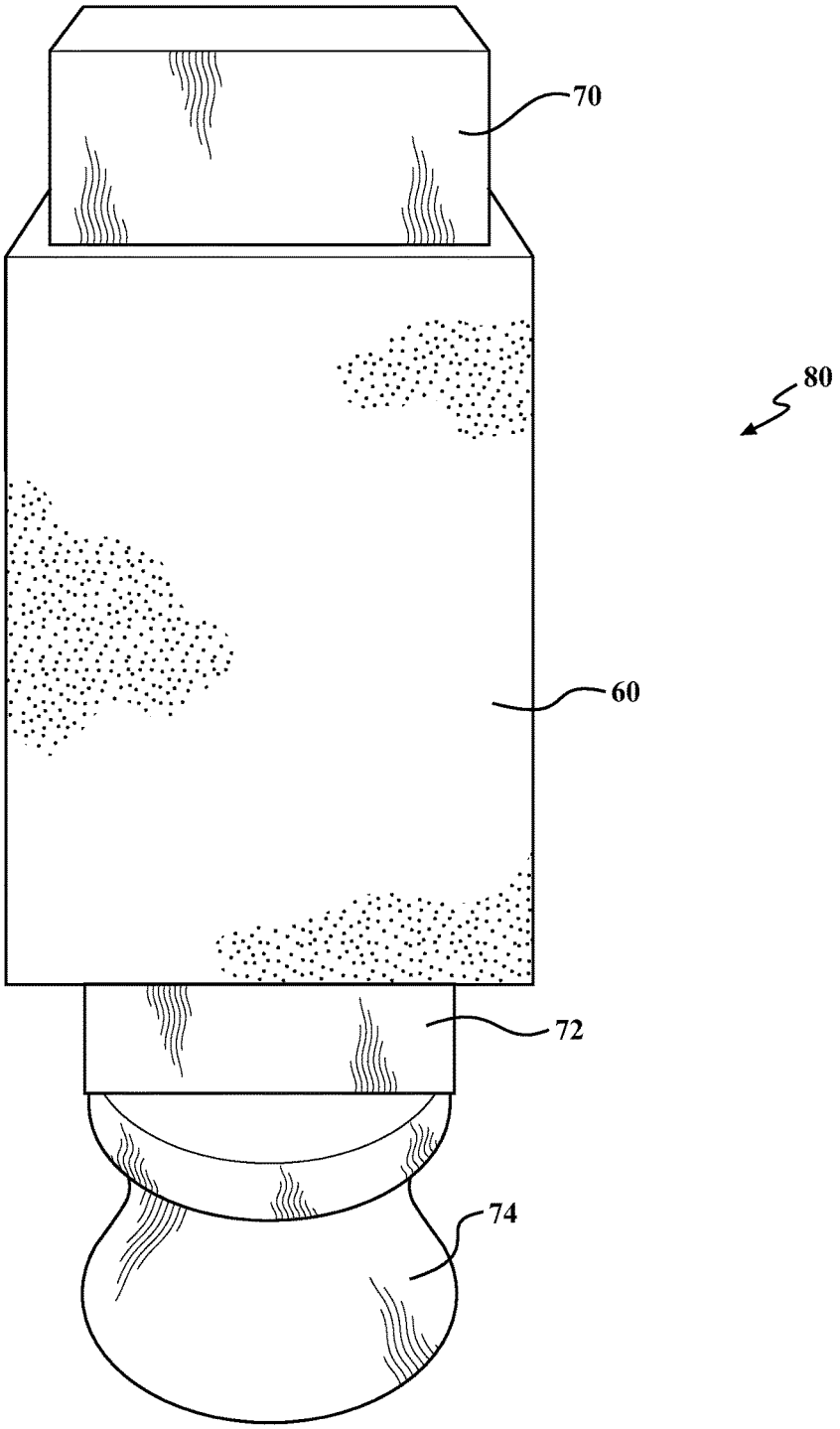
FIG. 7 is a schematic view of a mold assembly for the method to manufacture reticulated metal foam.

Next, the wax gating 40 and attached coated precursor 30 is pre-invested by pouring a slurry of diluted pre-investment ceramic plaster into the container 50 to form a pre-investment block 60 (step 110; FIG. 6, FIG. 7). The pre-investment may be performed with a ceramic plaster such as, for example, an Ultra-Vest® investment manufactured by Ransom & Randolph® of Maumee, Ohio, USA.

The ceramic plaster may be mixed per manufacturer's recommendations. However, it may be desirable, in some embodiments, for the ceramic plaster to be highly diluted, e.g., water to powder ratio of 55:100 used for Ultra-Vest® as compared to the manufacturer's recommended 39-42:100 to provide the diluted pre-investment ceramic plaster. It should be appreciated that various processes may be utilized to facilitate pouring such as a vibration plate to facilitate slurry infiltration into the coated precursor 30; location in a vacuum chamber to remove trapped air; etc. If a vacuum chamber is employed, the vacuum may be released once bubbles stop breaching the surface, or slurry starts setting up. The container 50 may then be topped off with excess slurry if necessary.

The highly water-diluted ceramic plaster reduces the strength of the ceramic, which facilitates post cast removal. The highly water-diluted ceramic plaster also readily flows into the polymer reticulated foam structure, ensuring 100% investment. This is significant in the production of very dense, fine pore, metal foams. This pre-investment may thus take the form of a block, panel, brick, sheets, etc. Once pre-invested, a rectangular prism of the diluted investment plaster with the foam encapsulated inside may be formed.

The pre-investment block 60 is then allowed to harden, e.g., for about 10 minutes, and once set, transferred to a humidity controlled drying room. In some embodiments, the final pre-investment block 60, when solidified, may be only slightly larger than the original polyurethane foam precursor 20 shape. This facilitates maintenance and support of the precursor 20 structural integrity that may be otherwise compromised. That is, the shape of the precursor 20 is protected within the pre-investment material. After the pre-investment block 60 is dried or sufficiently dried, a wax assembly procedure (step 112) may be performed. In some embodiments, the wax assembly procedure may be performed after about 2 hours drying time.

Figure 8B:
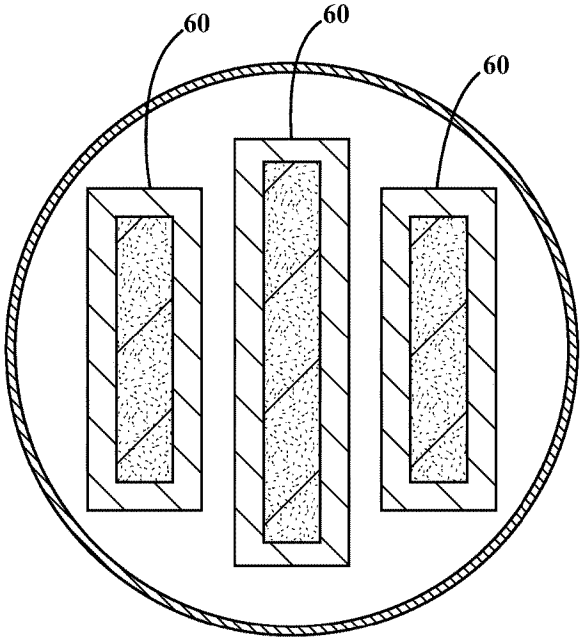
FIG. 8B is a cross-section schematic view of the alternative mold assembly of FIG. 8A.
Figure 8A:
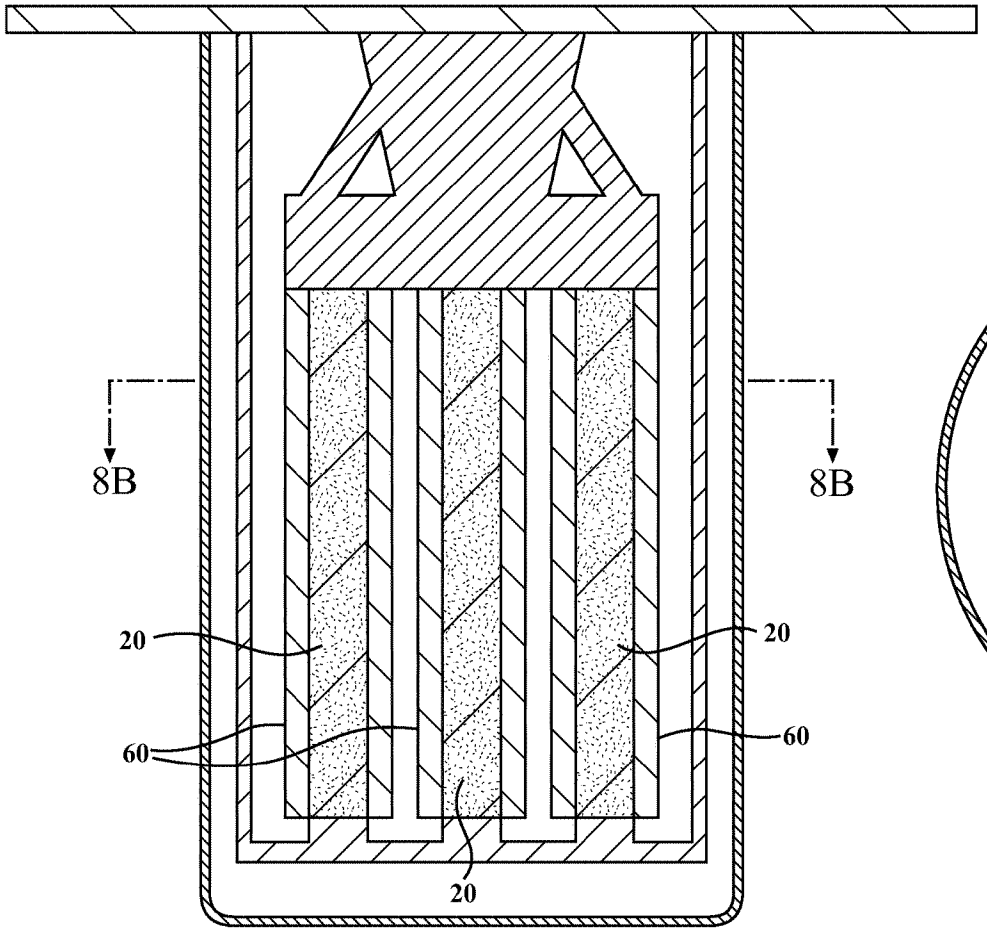
FIG. 8A is a schematic view of an alternative mold assembly for the method to manufacture reticulated metal foam.

The wax assembly procedure (step 112) may include attachment of gates 70, 72, and a pour cone 74, to the pre-investment block 60 to form a gated pre-investment block 80 (FIG. 7). Alternatively, multiple pre-investment blocks 60 may be commonly gated as a gated pre-investment block 80 (FIGS. 8A and 8B).

Figure 9:
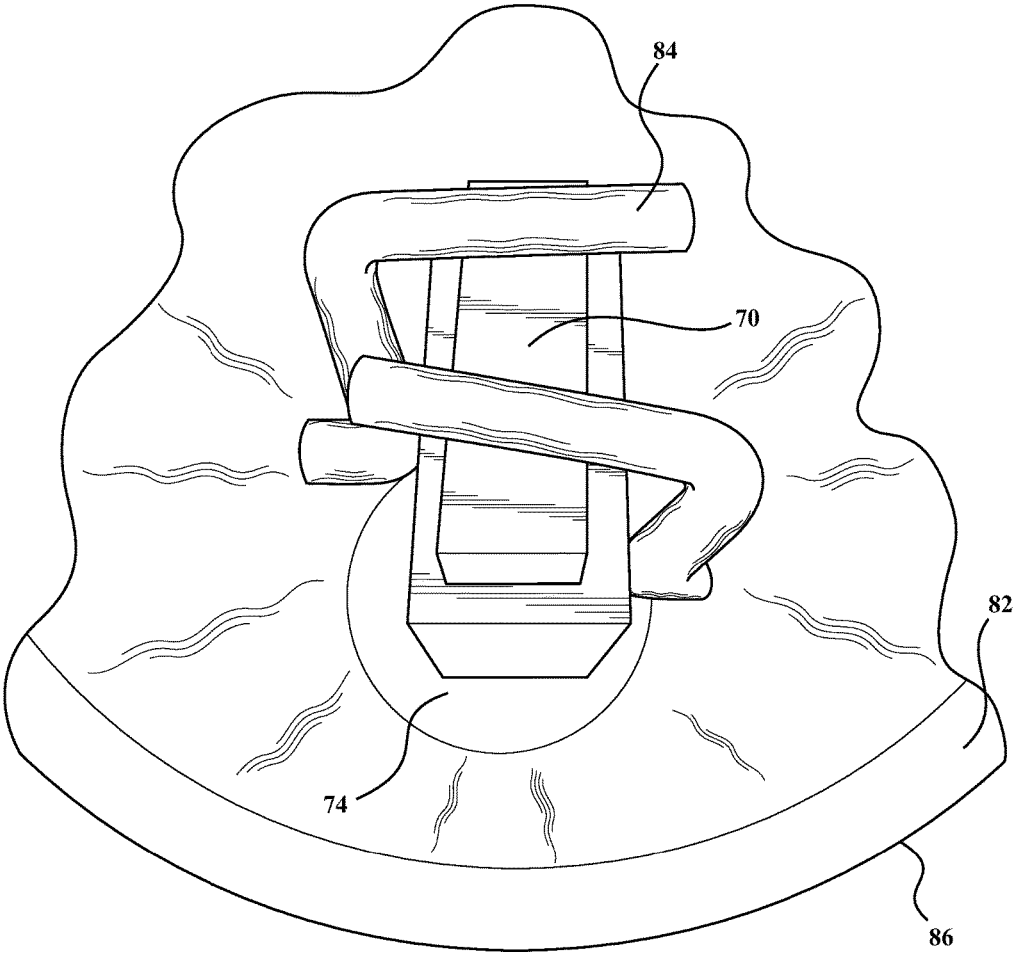
FIG. 9 is a schematic view of one step in the method to manufacture reticulated metal foam.
Figure 10:
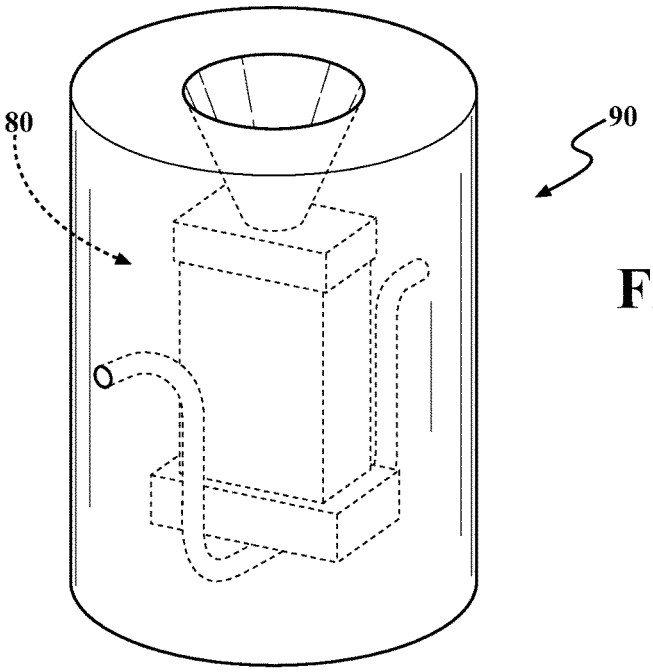
FIG. 10 is a schematic view of one step in the method to manufacture reticulated metal foam.

The gated pre-investment block 80 is then located within an outer mold assembly 82 with wax rods 84 as vents placed inside a wax-coated tube 86 (plan view shown in FIG. 9; isometric view shown in FIG. 10). That is, the wax rods 84 will eventually form vents in communication with the precursor 20 to receive the molten metal into a funnel type shape formed by the pour cone 74. In one example, the pre-invested blocks are arranged pour cone down onto an aluminum baseplate such that liquid wax may be poured into the bottom of wax-coated tube 86 to seal off pour cone 74, prior to final investment.

Next, the outer mold assembly 82 is invested with a ceramic plaster for final investment (step 114). In some embodiments, the ceramic plaster may be mixed per manufacturer's recommendations, e.g., water to powder ratio of about 28:100 of Glass-Cast™ 910 product may be used. The final investment of the mold 90 is thereby significantly more rigid and robust than the pre-investment ceramic plaster.

The mold 90 is then allowed to set up and dry in a humidity-controlled room (step 116; FIG. 10) before de-wax (step 118). In some embodiments, the set up period may be for minimum of about 2 hours. In some embodiments, the final mold 90 may be de-waxed for about a minimum 3-4 hours at about 250° F.

Once de-waxed, the mold 90 is inspected (step 120). Various inspection regimes may be provided.

Next, the final mold 90 is placed in a gas burnout furnace to burnout the original precursor 20 (step 122). In some embodiments, the burnout may, for example, follow the schedule: 300° F. to 1350° F. (732° C.) in 10.5 hours (100° F./hour); fast ramp, e.g., ramp rate of 100-200° F./hr max, to 1000° F. (538° C.) if all water driven out of mold; soak at 1350° F. (732° C.) until burnout complete which may require up to about 12-24 hours depending on mold size.

Figure 11:
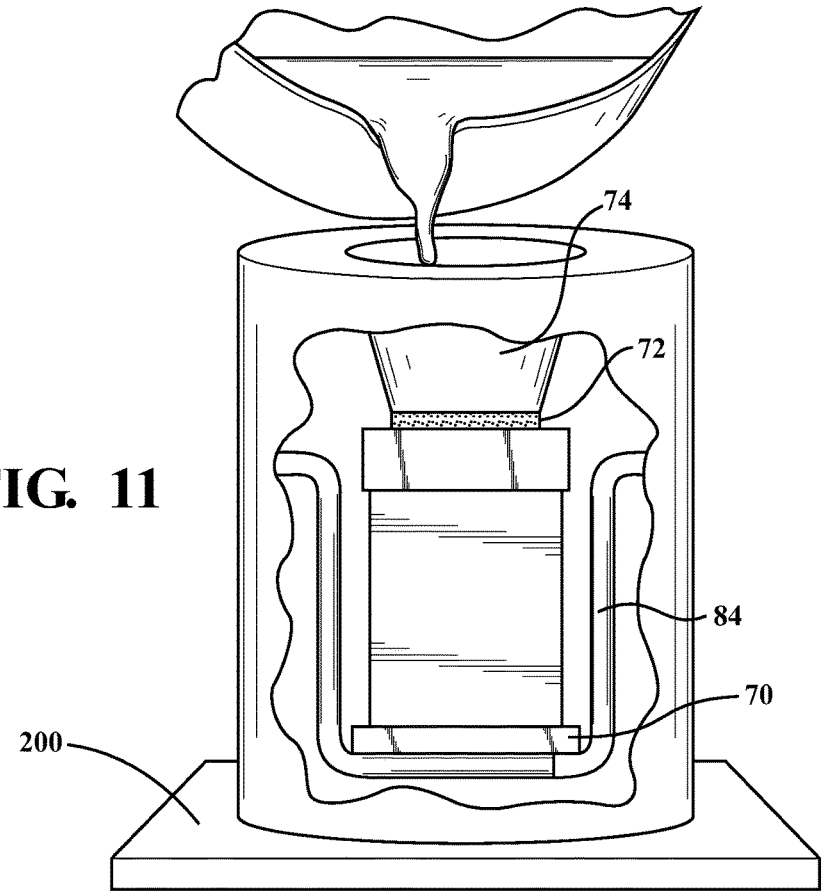
FIG. 11 is a schematic view of one step in the method to manufacture reticulated metal foam.

Next, the mold 90 receives the molten metal material (step 124; FIG. 11). The final mold 90 may be located in a pre-heat oven maintained at about 1350° F. adjacent to a molten metal, e.g., aluminum (A356, A356 and Al 6101 alloys) at a temperature of about 1350° F. (732° C.) with slag skimmed off surface prior to casting. The mold 90 is removed from the pre-heat oven and placed between metal plates designed to sandwich the mold 90 such that molten aluminum is readily poured into the pour cone until flush with the top.

In one embodiment, the mold 90 is located on a chill plate 200 such as a water-cooled tubed cold plate, a flat tube cold plate, and/or a vacuum-brazed fin cold plate (FIG. 11). For example, a tubed cold plate may include copper or stainless steel tubes pressed into a channeled aluminum extrusion, a flat tube cold plate may contain internal fins to increase performance and offer improved thermal uniformity, and a performance-fin cold plate may consist of two plates metallurgically bonded together with internal fins.

The chill plate 200 applies an externally driven temperature gradient in the mold 90 so that solidification progresses from the chilled end to the non-chilled end. In one example, the chill plate 200 receives water at about 32° F. (0° C.) such that the chill plate 200 operates at about room temperature, such as 70° F.-75° F. (21° C.-24° C.). The extent of chilling is such that the casting remains equiaxial with crystallization nucleating from all surfaces.

The mold 90 may then be pressurized (step 126). The pressure may be between about 5-10 psi or until aluminum exits the mold 90 via the vents formed by the wax rods 84. It should be appreciated that various pressurization and non-pressurization schemes may be alternatively utilized.

The mold 90 is then air cooled at room temperature (step 128). In some embodiments, the air cooling may be for about 4-5 hours. It should be appreciated various time periods may be alternatively employed.

The reticulated metal foam may then be removed via various mechanical and/or water sprays (step 130). For example, water may be sprayed to remove the internal investment and mechanical vibration may alternatively or additionally be utilized to facilitate material break up. Repeated rotation between water spray and mechanical vibration may facilitate clean metal foam formation. Alternatively, or in addition, a dental plaster remover such as a citric-based solution may be utilized to dissolve the internal investment.

The method 100 to manufacture reticulated metal foam via the dual investment solid mold with diluted pre-investment ceramic plaster is very fluid and fills even dense, fine pore size foams with ease, compared to current technology. The fluidity of the pre-investment reduces likelihood of entrapped bubbles in the foam structure to ensure 100% investment of the foam precursor. Pre-investment of the foam shapes also facilitates relatively larger foam sheets to be cast than existing technologies. This is because the pre-investment surrounds and completely encapsulates the delicate foam structure, once solidification occurs, the foam structure and shape is protected from distortion during the final solid mold investment step. When trying to cast larger foam sheets without the pre-investment, the weight of the final, heavier, and stronger ceramic investment can move and compress the polyurethane foam.

The pre-investment also maintains or increases dimensional tolerance as the foam is encapsulated in the light ceramic plaster. The relatively heavier, stronger ceramic, which is poured over the pre-investment, cannot exert pressure, move, or stress the delicate foam structure that has already been encapsulated in the diluted pre-investment ceramic plaster. The pre-investment step also eliminates the possibility of foam distortion or contamination during the wax assembly mold process. The pre-investment, which may be highly diluted with water as compared to the manufacturer's recommendation, is very weak. After casting, the pre-invested block is removed and can be easily washed away using regular water hose pressure, reducing time and potential for damage to the reticulated metal foam structure.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this disclosure are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is illustrative rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method to manufacture reticulated metal foam, comprising:

pre-investing a precursor with a pre-investment ceramic plaster to encapsulate the precursor, wherein the pre-investment ceramic plaster is about 55:100 water to powder ratio;

investing the encapsulated precursor with a ceramic plaster to form a mold; and pouring molten metal material into the mold while the mold is located on a chill plate operable to provide chilling of an extent that a casting formed by the mold remains equiaxial with crystallization nucleating from all surfaces.

2. The method as recited in claim 1, wherein the precursor is a reticulated foam structure.

3. The method as recited in claim 1, wherein the precursor is a polyurethane reticulated foam structure.

4. The method as recited in claim 1, wherein the precursor is completely encapsulated with the pre-investment ceramic plaster.

5. The method as recited in claim 1, further comprising, coating the precursor in a molten wax to increase ligament thickness.

6. The method as recited in claim 1, further comprising, coating the precursor in a molten wax to increase ligament thickness to provide an about 90% air to 10% precursor ratio.

7. The method as recited in claim 1, wherein the ceramic plaster is more rigid than the pre-investment ceramic plaster.

8. The method as recited in claim 1, wherein the ceramic plaster is about 28:100 water to powder ratio.

9. The method as recited in claim 1, wherein the chill plate operates at about room temperature.

10. The method as recited in claim 9, wherein the molten metal material is at a temperature of about 1350° F. (732° C.).

11. The method as recited in claim 1, wherein the chill plate applies an externally driven temperature gradient in the mold so that solidification progresses from the chilled end to the non-chilled end.

12. The method as recited in claim 1, wherein the reticulated metal foam is manufactured of aluminum.

13. A method to manufacture reticulated metal foam via a dual investment solid mold, comprising:

coating a precursor in a molten wax to increase ligament thickness;

pre-investing the waxed precursor with a pre-investment ceramic plaster to encapsulate the precursor, wherein the pre-investment ceramic plaster is about 55:100 water to powder ratio;

investing the encapsulated precursor with a ceramic plaster to form a mold; and pouring molten metal material into the mold while the mold is located on a chill plate.

14. The method as recited in claim 13, wherein the precursor is a reticulated foam structure.

15. The method as recited in claim 14, wherein the chill plate applies an externally driven temperature gradient in the mold so that solidification progresses from the chilled end to the non-chilled end.

16. The method as recited in claim 15, wherein the extent of chilling is such that a casting formed by the mold remains equiaxial in nature with crystallization nucleating from all surfaces.

17. A method to manufacture reticulated metal foam, comprising:

locating a mold on a chill plate, the chill plate configured to apply an externally driven temperature gradient in the mold so that solidification of a molten metal material in the mold progresses from a chilled end to a non-chilled end of the mold, the mold including a reticulated foam precursor that is pre-invested to form an encapsulated precursor, the encapsulated precursor invested with a ceramic plaster to form the mold, wherein the pre-investment ceramic plaster is about 55:100 water to powder ratio.

18. The method as recited in claim 17, wherein the extent of chilling is such that a casting formed by the molten metal material remains equiaxial with crystallization nucleating from all surfaces.

* * * * *